US006575356B2

(12) United States Patent
McClure

(10) Patent No.: US 6,575,356 B2
(45) **Date of Patent: *Jun. 10, 2003**

(54) CONTAINER WITH LOCKING REINFORCEMENT PANELS

(75) Inventor: Jack A. McClure, Omaha, NE (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/146,605

(22) Filed: May 14, 2002

(65) Prior Publication Data

US 2002/0130168 A1 Sep. 19, 2002

Related U.S. Application Data

(62) Division of application No. 09/757,375, filed on Jan. 8, 2001, now Pat. No. 6,402,020.

(51) Int. Cl.[7] ..... B65D 5/66

(52) U.S. Cl. ..... 229/143; 229/149; 229/191; 229/918

(58) Field of Search ..... 229/143, 149, 229/150, 154, 191, 197, 918, 919, 915

(56) References Cited

U.S. PATENT DOCUMENTS

| | | | | |
|---|---|---|---|---|
| 4,056,223 | A | | 11/1977 | Williams |
| 4,236,740 | A | | 12/1980 | Sorenson et al. |
| 4,319,710 | A | | 3/1982 | Osborne |
| 4,621,766 | A | | 11/1986 | McClure |
| 5,000,377 | A | | 3/1991 | McClure |
| 5,002,224 | A | | 3/1991 | Muise |
| 5,139,195 | A | | 8/1992 | McClure |
| 5,285,956 | A | | 2/1994 | Piepho |
| 5,289,970 | A | | 3/1994 | McClure |
| 5,289,971 | A | | 3/1994 | McClure |
| 5,588,585 | A | * | 12/1996 | McClure ..... 229/191 |
| 6,135,347 | A | | 10/2000 | Mueller |
| 6,402,020 | B1 | * | 6/2002 | McClure ..... 229/143 |

FOREIGN PATENT DOCUMENTS

| | | | | |
|---|---|---|---|---|
| WO | WO-86/05762 A1 | * | 10/1986 | ..... 229/918 |

* cited by examiner

*Primary Examiner*—Gary E. Elkins

(57) ABSTRACT

A container (10) formed from a one-piece blank (12) including a bottom panel (14), first and second opposed side walls (16), (18), and first and second end walls (20), (22). A top lid panel (24) connects to the first side wall and a bottom lid panel (26) connects to the second side wall. A locking tab (46) is formed in the first side wall and includes a thumb notch (48) located within the tab. The top lid panel includes a pair of cover latches (28) located on the outer corners thereof. The bottom lid panel includes a pair of alignment tabs (40) located on the outer corners thereof. Each end wall includes a hand hole lock (60), a lock slot (64), and a recess (66) located along the end wall exterior edge. The lock slot is located between the recess and the hand hole lock. Each end wall further includes first and second reinforcing panel sub-assemblies (56), (58), each having an inner panel (70), (100), a middle panel (72), (102), and an outer panel (74), (104). Each inner panel includes a pair of recesses (82) and an intermediate tab (84) all located along an inner panel exterior edge. Each middle panel includes a locking slot (86) near the middle panel exterior edge. The outer panel (74) of the first sub-assembly includes a recess (78) along an outer panel exterior edge and a hand hole (80). As assembled, the locking tabs are disposed within the lock slots with the intermediate tab of the inner panel at least partially inserted into the locking tab thumb notch. The cover latches are inserted into the locking slots of the end walls. The alignment tabs are positioned in the aligned recesses of the outer panel and the end wall.

3 Claims, 5 Drawing Sheets

CONTAINER WITH LOCKING REINFORCEMENT PANELS

CROSS-REFERENCE TO RELATED APPLICATIONS

This application is a division of U.S. patent application Ser. No. 09/757,375, filed Jan. 8, 2001, U.S. Pat. No. 6,402,020, issued Jun. 11, 2002.

FIELD OF THE INVENTION

The present invention pertains to paperboard containers having reinforced corners, and in particular, to locking mechanism used in the paperboard container blanks to help maintain an erected container form.

BACKGROUND OF THE INVENTION

It is well known to form paperboard containers that use extra wall layers to increase wall thickness at the corners of the container to improve stacking strength. Such containers are typically used with products that are unusually heavy, e.g., frozen meat, paper files, books, canned goods, etc.

One examples of such a container is shown in U.S. Pat. No. 5,000,377 to the present inventor. This prior container uses doubled-over reinforcing panel sub-assemblies at its interior corners and glue flaps about its exterior upper surface. This container is typically formed by machine. However, this can be a problem for small business that cannot afford the huge investment required to install tray formers and case sealers. To date, small manufacturers have had to settle for much more expensive and less efficient box styles than their large competitors. These expensive and less efficient box styles include "swing under" styles, double wall RSC's (regular slotted containers), and various combinations of hand-erected trays and HSC's (half slotted containers), all of which require much more board for a given endurance level.

Thus, a need exists for an efficient and less expensive container that may be used with these heavier products and that include superior locking mechanisms. The preferred container should be capable of relatively easy formation from paperboard blanks without the use of machinery or tooling. The present invention is directed to fulfilling these needs and others as described below.

SUMMARY OF THE INVENTION

In accordance with the teaching of the present invention, an efficient and easily hand-formed container is provided from a one-piece paperboard blank. The invention includes various inventive features which may be used singularly or in combination.

In one embodiment, the features are combined and the container includes a bottom panel, first and second opposed side walls, and first and second opposed end walls. A top lid panel connects to the first side wall and a bottom lid panel connects to the second side wall. A locking tab is formed in the first side wall and includes a thumb notch located within the tab. The top lid panel includes a pair of cover latches located on the outer corners thereof. A bottom lid panel connects to the second side wall and includes a pair of alignment tabs located on the outer corners thereof.

Each end wall includes a hand hole lock, a lock slot, and a recess located along an end wall exterior edge. The lock slot is located between the recess and the hand hole lock. Each end wall further includes first and second reinforcing panel sub-assemblies, each having an inner panel, a middle panel, and an outer panel. Each inner panel includes a pair of recesses with an intermediate tab located along an inner panel exterior edge. Each middle panel includes a locking slot near a middle panel exterior edge. The outer panel of the first sub-assembly includes a recess along an outer panel exterior edge and a hand hole.

As assembled, the locking tabs are disposed within the lock slots with the intermediate tab of the inner panel at least partially inserted into the locking tab thumb notch. The cover latches are inserted into the locking slots of the end walls. The alignment tabs are positioned in the aligned recesses of the outer panel and the end wall.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention is a reinforced paperboard container that is easily hand-formed and includes one or more locking mechanisms that hold various container panels securely together. One such locking mechanism includes a uniquely shaped locking tab and lock slot that engage one another as assembled. A dogleg in the fold line in one of the related panels ensures that the lock slot is open and available to accept the locking tab. Another such locking mechanism is a uniquely shaped cover latch insertable into a cover latch slot formed in an end panel. Recesses are provided in various end panels to align the panels. Lastly, a hand hole lock is provided in the end wall. Both the recesses and hand hole lock work to hold the end panels together against the push of the cover latch when it is inserted into the cover latch opening. These aspects and others are described in detail below.

FIGS. 1–4 illustrate an embodiment of a container 10 embodying each of the various inventive aspects of the present invention. As will be appreciated, however, these inventive portions may be used separately as well. Generally speaking, the container blank has a rectangular configuration with straight lines and perpendicular folds and edges. However, portions of the blank are of an irregular shape to provide features which will be discussed herein.

Figure 2:
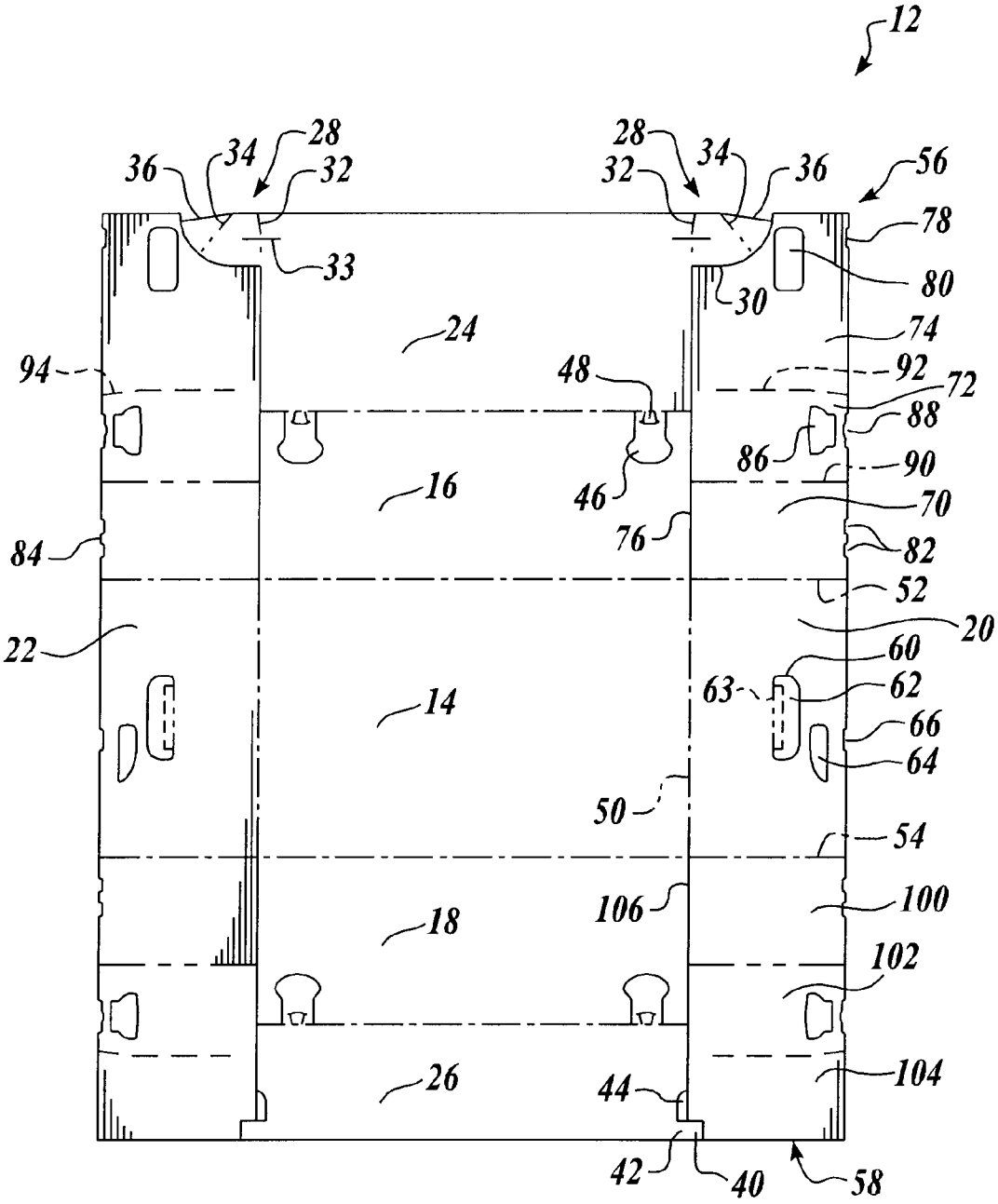
FIG. 2 is a plan view of the paperboard blank from which the container of FIG. 1 is formed.

Referring to FIG. 2, the container blank 12 includes a bottom panel 14 with two pairs of opposed edges. First and second side walls 16, 18 are hingedly connected to a first pair of bottom panel opposed edges. First and second end walls 20, 22 are hingedly connected to the remaining pair of bottom panel opposed edges. In the embodiment shown, the side walls 16, 18 are located along the longer edges of the bottom panel 14, and the end walls 20, 22 are located along the shorter edges. These hinged attachments are formed conventionally, such as by scoring.

The first side wall 16 includes a top lid flap 24 hingedly connected to the first side wall, opposite the bottom panel 14. The second side wall 18 includes a bottom lid flap 26. The lid flaps 24, 26 and side walls 16, 18 are arranged end-to-end in a series, with the bottom panel 14 in the center of the series. The top lid flap 24 includes cover latches 28 formed at each outer corner edge.

Figure 9:
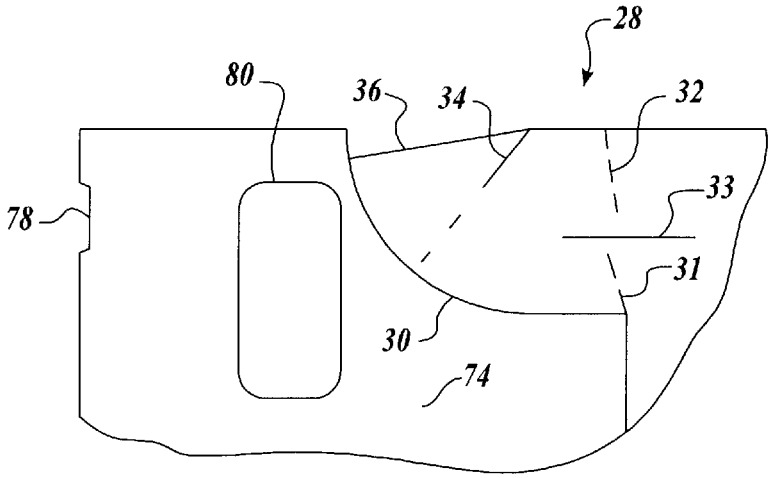
FIG. 9 is a detail plan view of the cover latch shown in FIG. 2.

Referring to FIG. 9, each cover latch 28 includes an arcuate outer edge shape 30. First and second inner scores 31, 32 are provided to distinguish the cover latch from the top lid panel 24. A transverse cut line 33 is provided between the first and second inner lines 31, 32. The transverse cut line 33 extends into both the cover latch 28 and the top lid flap 24. A third score line 34 is formed in the body of the latch 28, at a radial orientation. The first and second scores 31, 32 are spaced apart from the third score 34. As shown, both the first score line 31 and the second score line 32 are angled outward for reasons are described below. Such angling is preferred but may be omitted for a particular arrangement. In the embodiment shown, the first and second scores are not oriented with the same angle—the first is more outwardly angled. The outermost edge 36 of the cover latch 28 is clipped inwardly to facilitate proper engagement with the cover latch slots.

Figure 7:
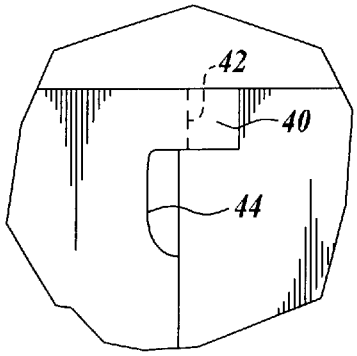
FIG. 7 is a detail plan view of the alignment tab shown in FIG. 2.

Referring back to FIG. 2, the bottom lid flap 26 includes alignment flaps 40 formed at each outer corner edge. The alignment flaps 40 are generally rectangularly shaped with an offset fold line 42. (See also FIG. 7.) A small portion of the lid 44 is removed from a location immediately inward of the alignment flap 40.

Figure 5:
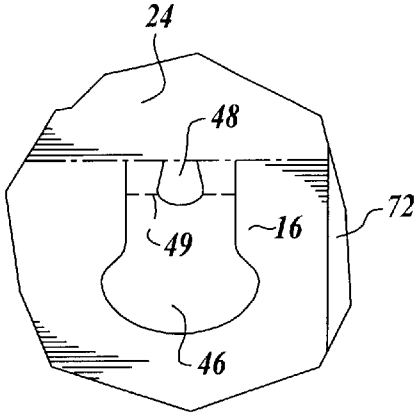
FIG. 5 is a detail plan view of the locking tab shown in FIG. 2.

Each side wall further includes locking tabs 46. The locking tabs 46 are mushroom-shaped, with the base of the mushroom aligning with the hinge line between the side wall and its respective lid flap. The locking tab 46 includes a thumb notch 48 at the base of the mushroom shape, adjacent the hinge line. See FIG. 5. A secondary fold line 49 is available to simplify assembly, as described below.

The first and second end walls 20, 22 are formed similarly, except as mirror images of one another. Thus, for brevity, the first end wall will be described. The first end wall 20 is joined to the bottom panel 14 along hinge line 50. The end wall has a first lateral edge defined by hinge line 52, and a second lateral edge defined by hinge line 54. The hinge lines 52, 54 are located at either end of and transverse to the aforementioned bottom panel hinge line 50. Each hinge line 52 and 54 joins a series of reinforcing panel sub-assemblies generally indicated at 56 and 58, respectively.

Figure 1:
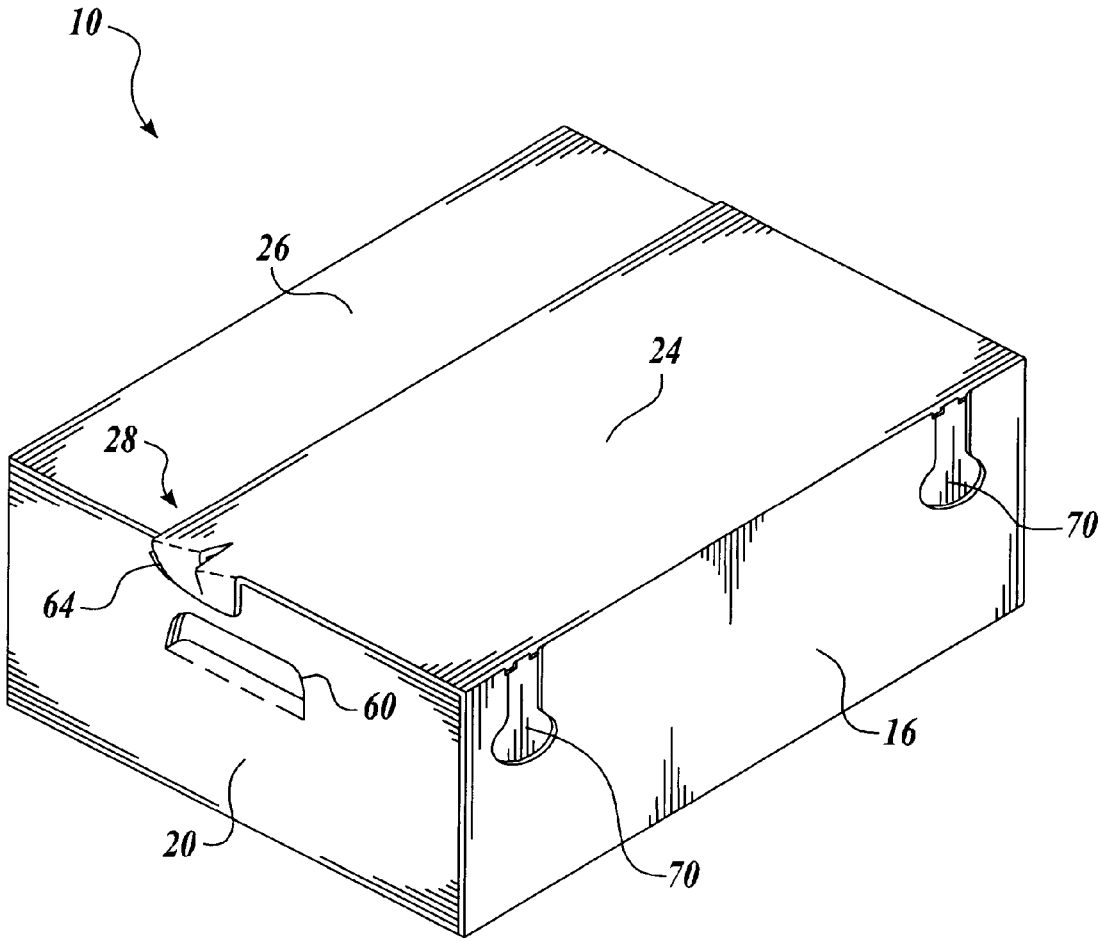
FIG. 1 is a perspective view of a container formed in accordance with the present invention.
Figure 8:
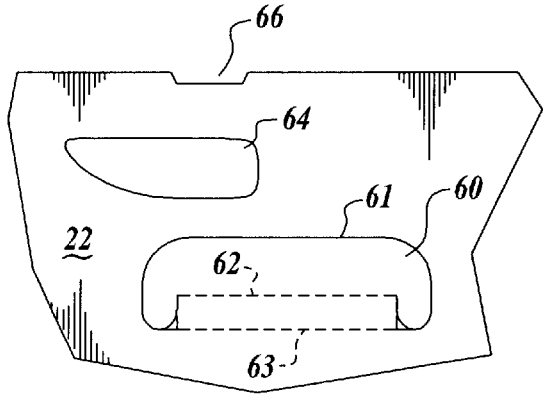
FIG. 8 is a detail plan view of the cover latch slot and hand hole lock of the end wall shown in FIG. 2.

Each end wall includes a hand hole lock 60 formed from an arcuate cut line 61 and first and second perforate lines 62, 63. See FIG. 8. Cover latch slots 64 are located above the hand hole lock 60 in the finished container (as can be seen in FIG. 1.) Each end wall 20 also includes a recess 66 located along the end wall's exterior edge. The recess 66 is preferably cut with sharp, 90 degree corners.

The first reinforcing panel sub-assembly 56 includes a series of hingedly connected inner, middle and outer panels 70, 72, 74. A severing line 76 divides the side wall 16 from the inner and middle panels 70, 72. The severing line 76 also divides the top lid panel 24 from the outer panel 74 in a manner which forms the cover latch 28. The bottom panel hinge line 50 is slightly inwardly offset from the severing line 76, so as to facilitate the folding operations described below.

Figure 6:
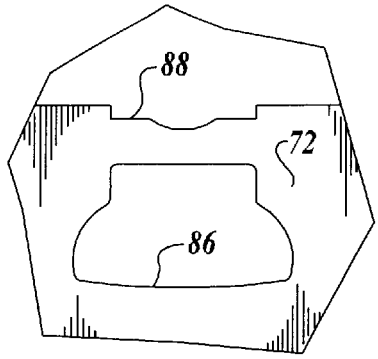
FIG. 6 is a detail plan view of the lock slot shown in FIG. 2.

The outer panel 74 includes an alignment flap recess 78 and a hand hole 80. The recess 78 is preferably formed with sharp 90 degree corners. The inner panel 70 includes an outer edge having a pair of recesses 82 that are preferably formed with sharp 90 degree corners. The material between the recesses forms a sharply-cornered intermediate tab 84. The middle panel 72 includes a lock slot 86 located near the middle panel outer edge. See FIG. 6. The lock slot 86 is shaped and sized to accept the mushroom-shaped locking tab 46 formed in the side wall 16. The outer edge of the middle panel includes a recess 88. The recess 88 is laterally aligned with the lock slot 86 and provides leeway for insertion of the locking tab 46 into the lock slot 86.

The hinge line 90 joining the inner and middle panels is a perforated and scored line. The hinge line 92 joining the middle and outer panels is perforated. While the hinge lines 52, 90, and 92 of the first sub-assembly are essentially orthogonal to the bottom panel hinge line 50, a distal portion (labeled 94 in FIG. 2) of the hinge line 92 is slightly angled into the middle panel 72. The hinge line 92 thus has a dog-leg shape.

The second reinforcing panel sub-assembly 58 also includes a series of hingedly connected inner, middle and outer panels 100, 102, 104. As above, a severing line 106 divides the side wall 18 from the inner and middle panels 100, 102. This severing line 106 also divides the bottom lid panel 26 from the outer panel 104 in a manner which forms the alignment flap 40. The alignment flap 40 is joined to the bottom lid panel 26 by a hinge line 42 which is linear, though outwardly offset slightly, from the severing line 106. As above, the bottom panel hinge line 50 is slightly inwardly offset from the severing line 106, so as to facilitate folding. The panels of the second sub-assembly are similar to those of the first sub-assembly, except the outer panel 104 is cut to accommodate the alignment flap 40 and does not include a recess nor a hand hole.

Thus, as can be seen from studying FIG. 2, the container blank is symmetrical about a longitudinal center line, but is not symmetrical about a transverse center line, e.g., the cover latches 28 are located at only the upper region of the blank in FIG. 2 and the alignment flaps 40 are located at only the lower region.

The container 10 is erected as follows. Starting from a horizontally-oriented container blank 12, each reinforcing panel sub-assembly 56, 58 is folded upward, out of the plane of the blank along hinge lines 52 and 54. The sub-assembly middle panel 72 is folded inward approximately 180 degrees from the inner panel 70, while simultaneously folding the outer panel 74 upward 90 degrees from the middle panel 72. The end result is a doubling-over of the outer and middle panels 74, 72 onto the end wall 20 and inner panel 70, respectively. See FIG. 4. The dog-leg fold line 92 between the middle and outer panels causes a vacancy between the inner panel 70 and the middle panel 72. This vacancy facilitates assembly. As shown, the hand hole 80 and recess 78 in the first sub-assembly outer panel 74 align with the hand hole lock 60 and recess 66 of the end wall 20, respectively.

After both reinforcing panel sub-assemblies have been formed, the combined sub-assembly and end wall structures are folded upright along the bottom panel hinge line 50. As shown best in FIGS. 1 and 3, the hand hole lock 60 is pushed inward to frictionally engage the adjacent outer panel. The side walls 16, 18 are then folded upright from the bottom panel along their available hinge lines. Simultaneously, the locking tab 46 is pushed inward and is made to go over the inner panel recesses 82 and the middle panel recess 88. The locking tab 46 is then inserted into the lock slot 86 of the middle panel 72. See FIG. 4. In going over the inner panel recesses 82, the inner panel intermediate tab 84 is inserted through the thumb notch 48 of the locking tab. See FIG. 4. This provides a frictional relationship between the locking tab 46 and the side wall which helps to ensure the continued engagement of the locking tab in the lock slot 86. This frictional relationship also aids in preventing movement of the container walls relative to one another.

Figure 3:
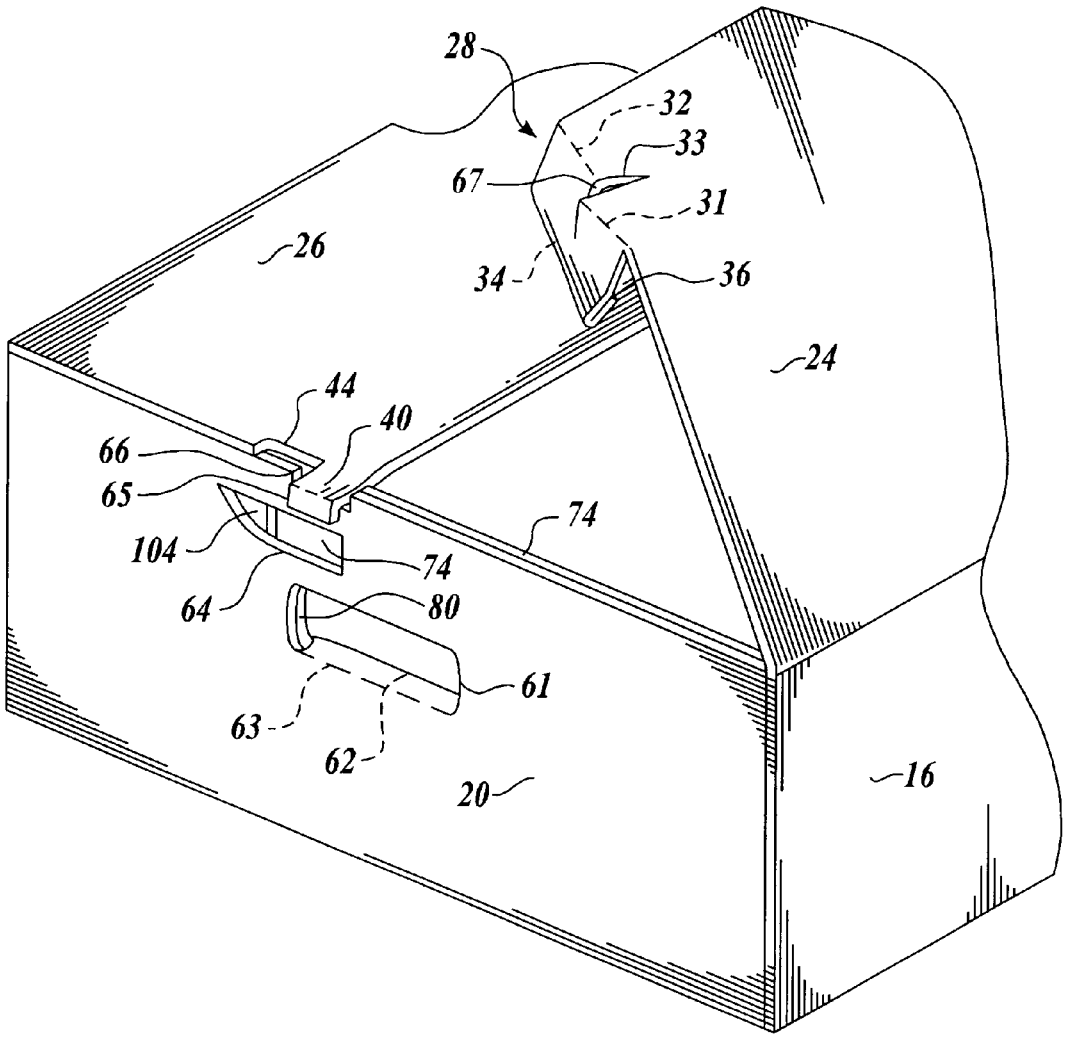
FIG. 3 is a fragmentary perspective view of an end wall exterior during assembly.
Figure 4:
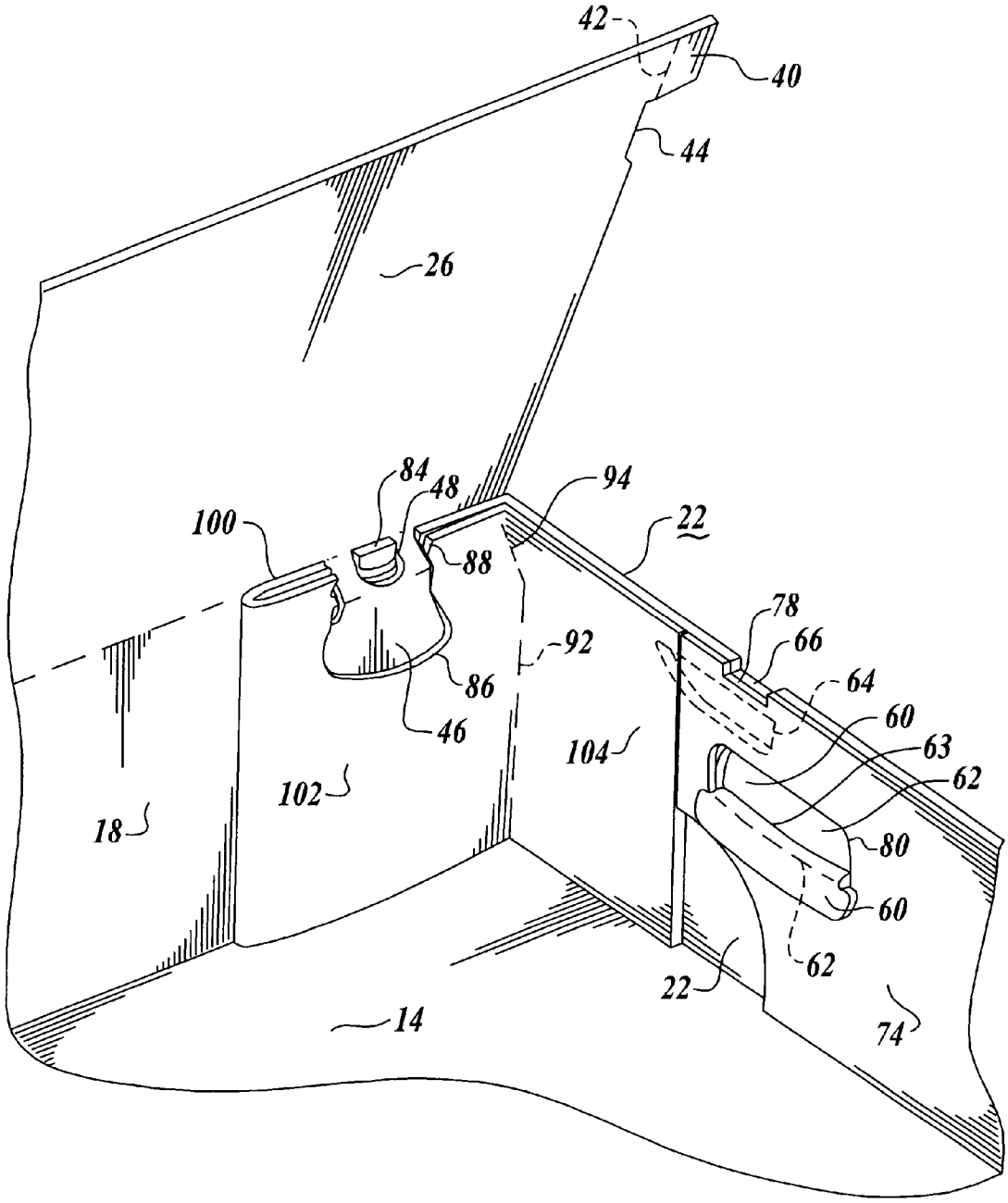
FIG. 4 is a fragmentary perspective view of an end wall interior during assembly.

Referring now to FIG. 3, the bottom lid flap 26 is folded horizontally until the alignment tabs 40 are located at the end wall recess 66 and the outer panel recess 78. The alignment tabs 40 extend slightly beyond the outer face of the end wall and will eventually be folded downward by the cover latches 28. Upon being folded downward, a proximal exterior edge 65 of the tab 40 becomes vertically oriented and exposed beyond the exterior surface of the end wall 20. As is also shown in FIG. 3, the cover latch 28 is folded about its first and second score lines 31, 32. When the cover latch 28 is folded along these scores 31 and 32, the transverse cut line 33 is forced into offset displacement, thereby exposing an upright surface 67 in the cut. The distal portion of the cover latch is folded 180 degrees about the third fold line 34 so that the distal portion tucks in and under the first and second score lines 31 and 32.

The folded cover latches 28 of the top lid flap 24 are inserted into the cover latch slots 64 of the end walls. In doing so, the cover latches force the alignment tabs 40 into the recesses 66 and 78 therebelow. The small portion 44 of the lid that was removed below the alignment flap allows the alignment flap to bend slightly and be forced in this manner. The placement of the alignment flap in the recesses provides a locking function by helping to keep the end wall and outer panel adjacent one another and by helping to prohibit the bottom lid flap from moving laterally out of position. The cover latches further fold the ends of the alignment tabs downward. The now exposed exterior edges 65 of the alignment tabs engage frictionally with the exposed upright surfaces 67 of the cut 33. This ensures the alignment tab's engagement in the recesses 78 and 66, and ensures capture of the cover latch against the alignment tab.

As shown best in FIG. 1, the bottom portion of the inserted cover latch 28 is sandwiched between the end wall 20 and the reinforcing panel sub-assembly. The edge 36 of each cover latch 28 frictionally engages with the upper edge of the cover slot 64. This action helps to maintain the cover latch in the slot. As assembled, a portion of the lid flaps overlaps, with the bottom lid flap being beneath the top lid flap.

As will be appreciated from a reading of the above, container 10 includes reinforced corners for improved stacking strength and the additional benefits associated with the various inventive locking mechanisms. The locking tab and lock slot engage one another in a secure manner. A dogleg in the fold line in one of the related panels ensures that the lock slot is open and available to accept the locking tab. The cover latch and cover latch slot are easily mated and when assembled provide the function of forcing the alignment tabs into adjacent recesses. The placement of the alignment tab in the recesses holds the end walls together and helps the container maintain its overall orthogonal panel orientations. In addition, the container blank may be prepared with the requisite score lines, blanking and other details, and then shipped to an end user, who, with relatively simple folding and interlocking operation, may form the blank into a finished container.

In addition, the cost of producing the present invention container blank is reduced while simultaneously providing an increase in compression strength. In one embodiment, the container size is reduced from about 21 square feet to about 16 square feet, with a corresponding compression strength increase from 1,437 pounds to 2,513 pounds. Corrugated paperboard and shipping costs may be further reduced by using a smaller size such that the container fits two wide on both a corrugator former and a shipping trailer, instead of the single wide size as was necessary with the prior container.

While the preferred embodiment of the invention has been illustrated and described, it will be appreciated that various changes can be made therein without departing from the spirit and scope of the invention. In particular, the drawings and the foregoing descriptions are not intended to represent the only forms of the invention in regard to the details of its construction and manner of operation. In deed, the inventive aspects taught by the present invention may be practiced alone or in combination. Further, as will be appreciated by those skilled in the art, various modifications are possible in how the various fold lines, etc. are formed. For example, perforations may be used in some instances, while crushes or even cuts are used in others.

The embodiments of the invention in which an exclusive property or privilege is claimed are defined as follows:

1. A container formed from a one-piece blank, comprising:

a bottom panel having adjacent side and end edges;

a first side wall hingedly connected to one said side edge of the bottom panel:

a top lid panel hingedly connected to said first side wall, a locking tab formed in said first side wall at the hinged connection, the locking tab including an aperture located within the tab;

a first end wall hingedly connected to an end edge of the bottom panel; the first end wall having opposed side edges oriented orthogonal to the hinged connection to the bottom panel;

the first end wall including:

a reinforcing panel sub-assembly hingedly connected to an end wall side edge and including a first panel, and a second panel; one of said first panel and said second panel including a locking slot near a middle panel exterior edge; the other of first panel and said second panel including a pair of recesses with an intermediate tab located along an inner panel exterior edge; and wherein as assembled, the locking tab is disposed within the lock slot with the intermediate tab inserted into the locking tab aperture.

2. A container formed from a one-piece blank, comprising:

a bottom panel having adjacent side and end edges;

a first side wall hingedly connected to one said side edge of the bottom panel;

a top lid panel hingedly connected to said first side wall, a locking tab formed in said first side wall at the hinged connection, the locking tab including an aperture located within the tab;

a first end wall hingedly connected to an end edge of the bottom panel; the first end wall having opposed side edges oriented orthogonal to the hinged connection to the bottom panel;

the first end wall including:

a first panel hingedly connected to an end wall edge; said panel including a pair of recesses with an intermediate tab located along an inner panel exterior edge; and wherein as assembled, the locking tab is disposed within the recesses with the intermediate tab inserted into the locking tab aperture.

3. A container formed from a one-piece blank; comprising:

a bottom panel having adjacent side and end edges;

a side wall hingedly connected to one said side edge of the bottom panel;

a locking tab formed in said side wall adjacent to its upper edge, the locking tab including an aperture located within the tab;

an end wall hingedly connected to an end edge of the bottom panel; the end wall having opposed side edges oriented orthogonal to the hinged connection to the bottom panel;

the end wall including:

a first panel hingedly connected to an end wall side edge; said panel including a pair of recesses with an intermediate tab located along an inner panel exterior edge; and wherein as assembled, the locking tab is disposed within the recesses with the intermediate tab inserted into the locking tab aperture.

* * * * *